US007536017B2

(12) United States Patent
Sakurai et al.

(10) Patent No.: US 7,536,017 B2
(45) Date of Patent: May 19, 2009

(54) CROSS-TALK CANCELLATION

(75) Inventors: Atsuhiro Sakurai, Tsukuba (JP); Steven Trautmann, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 907 days.

(21) Appl. No.: 11/125,927

(22) Filed: May 10, 2005

(65) Prior Publication Data

US 2005/0254660 A1 Nov. 17, 2005

Related U.S. Application Data

(60) Provisional application No. 60/571,234, filed on May 14, 2004.

(51) Int. Cl.
*H04R 5/00* (2006.01)

(52) U.S. Cl. ..... 381/17

(58) Field of Classification Search ..... 381/17, 381/18, 1

See application file for complete search history.

(56) References Cited

U.S. PATENT DOCUMENTS 5,995,631 A * 11/1999 Kamada et al. ..... 381/17
6,668,061 B1 * 12/2003 Abel ..... 381/17

* cited by examiner

*Primary Examiner*—Ping Lee
(74) *Attorney, Agent, or Firm*—Mirna G. Abyad; Wade J. Brady, III; Frederick J. Telecky, Jr.

(57) ABSTRACT

Audio cross-talk cancellation by inverse HRTF matrix only for low frequencies; high frequencies rely upon the natural barrier of a listener's head. The low frequency cutoff is determined by a peak in the inverse matrix of the head-related transfer functions.

5 Claims, 3 Drawing Sheets

CROSS-TALK CANCELLATION

CROSS-REFERENCE TO RELATED APPLICATIONS

This application claims priority from provisional patent application No. 60/571,234, filed May 14, 2004.

BACKGROUND OF THE INVENTION

The present invention relates to digital audio signal processing, and more particularly to loudspeaker cross-talk cancellation devices and methods.

Cross-talk cancellation is an essential component of loudspeaker-based three-dimensional audio systems. For the case of stereo reproduction (two loudspeakers), cross-talk denotes the signal from the right speaker that is heard at the left ear and vice-versa. Without cross-talk, it is theoretically possible to generate virtual sound sources located at any angle from the listener by processing the signal using head-related transfer functions (HRTF) corresponding to the desired position of the virtual sound source. In a typical situation with cross-talk, however, the intended effect cannot be achieved properly.

The basic solution to eliminate cross-talk was proposed in B. Atal et al., U.S. Pat. No. 3,236,949 (1966). This solution consists of inverting the 2×2 matrix of the HRTFs from the two loudspeakers to the two ears. By applying the inverse matrix to the signals before reproduction at the loudspeakers, it is in principle possible to reproduce the original acoustic signals at the ears. The classical cross-talk cancellation method has received a few refinements, but remains essentially the same as in 1966. These refinements include: a matrix diagonalization method that dramatically reduces computational cost as described in D. Cooper et al, Prospects for Transaural Recording, 37 J. Audio Eng. Society 3-19 (1989) and a solution to widen the allowable area where the effect can be achieved (sweet spot) through a convenient choice of speaker angles as described in O. Kirkeby et al., The Stereo Dipole—A Virtual Source Imaging System Using Two Closely Spaced Loudspeakers, 46 J. Audio Eng. Society 387-395 (1998).

Nevertheless, cross-talk cancellation faces a number of limitations that continue to exist in spite of the great deal of research effort dedicated to their solutions. Some of the limitations are: (1) room reflections that occur in real-world listening situations; (2) imprecision of available HRTF data based on dummy-head measurements; (3) head movement; (4) ill-conditioned inverse HRTF matrices and consequent peaks in the magnitude spectrum. The approach proposed in the Kirkeby et al. article regarding problems (3) and (4) is to enforce a convenient speaker angle; while other approaches make use of least-squares optimization that requires feedback from microphones, as for example in P. Nelson et al., Adaptive Inverse Filters for Stereophonic Sound Reproduction, 40 IEEE Trans. Signal Proc. 1621-1632 (1992).

However, the limitations (1)-(4) persist without good robust solutions.

SUMMARY OF THE INVENTION

The present invention provides cross-talk cancellation by use of HRTF matrix inversion only in low frequency bands as determined by spectral peaks.

DESCRIPTION OF THE PREFERRED EMBODIMENTS

1. Overview

Figure 1A:
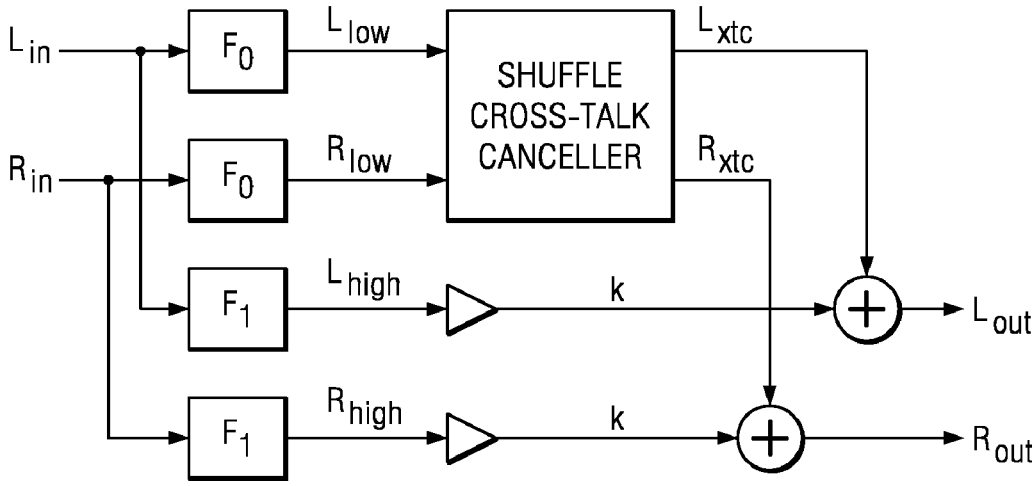
FIGS. 1*a*-1*b* show a preferred embodiment filter and method flow diagram.
Figure 1B:
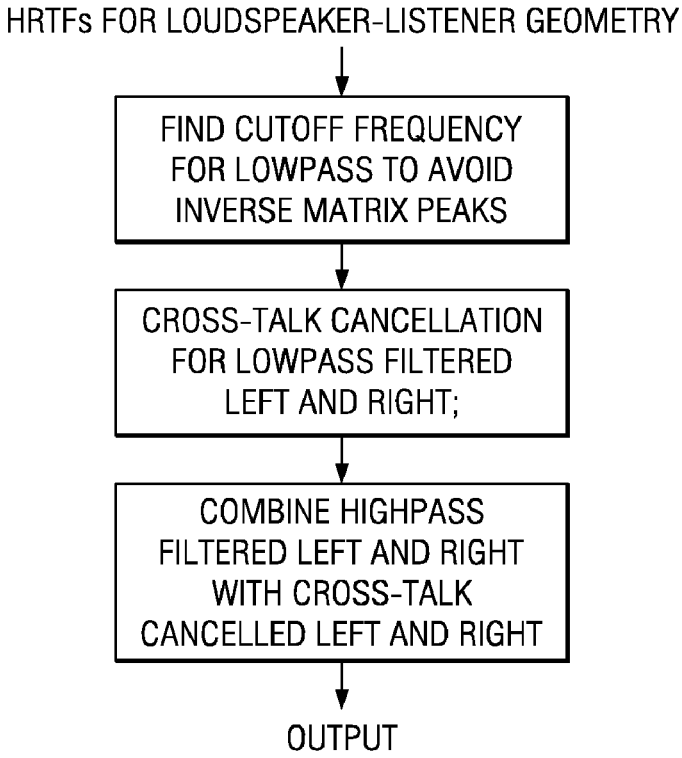

Preferred embodiment loudspeaker cross-talk cancellation methods partition audio frequencies into bands and apply filtering by an inverse acoustic transfer function matrix only to frequency bands which avoid peaks in the inverse matrix elements. FIG. 1*a* illustrates functional blocks of a preferred embodiment cross-talk cancellation circuit, and FIG. 1*b* is a flow diagram.

Preferred embodiment systems perform preferred embodiment methods with any of several types of hardware: digital signal processors (DSPs), general purpose programmable processors, application specific circuits, or systems on a chip (SoC) such as combinations of a DSP and a RISC processor together with various specialized programmable accelerators such as for FFTs and variable length coding (VLC). A stored program in an onboard or external flash EEPROM or FRAM could implement the signal processing.

2. HRTF Matrix Inversion

Figure 2:
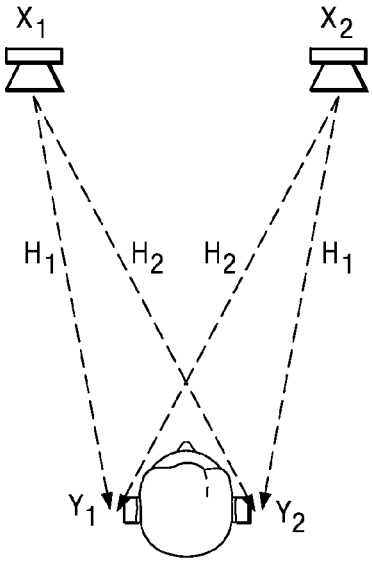
FIG. 2 (PRIOR ART)
FIG. 2 illustrates head-related acoustic transfer function geometry.

First review the classical HRTF matrix inversion method for cross-talk cancellation as described in U.S. Pat. No. 3,236,949. Consider a listener facing two loudspeakers, A on the listener's left and B on the right, as shown in FIG. 2. Let $X_1(e^{j\omega})$ and $X_2(e^{j\omega})$ denote the (short-term) Fourier transforms of the analog signals which drive loudspeakers A and B, respectively, and let $Y_1(e^{j\omega})$ and $Y_2(e^{j\omega})$ denote the Fourier transforms of the analog signals actually heard at the listener's left and right ears, respectively. Presuming a symmetrical speaker arrangement, the system can then be characterized by two acoustic transfer functions, $H_1(e^{j\omega})$ and $H_2(e^{j\omega})$, which respectively relate to the short and long paths from speaker to ear; that is, $H_1(e^{j\omega})$ is the transfer function from left speaker to left ear or right speaker to right ear, and $H_2(e^{j\omega})$ is the transfer function from left speaker to right ear and from right speaker to left ear. This situation can be described as a linear transformation from $X_1$, $X_2$ to $Y_1$, $Y_2$ with a 2×2 matrix with elements $H_1$ and $H_2$:

$$\begin{bmatrix} Y_1 \\ Y_2 \end{bmatrix} = \begin{bmatrix} H_1 & H_2 \\ H_2 & H_1 \end{bmatrix} \begin{bmatrix} X_1 \\ X_2 \end{bmatrix}$$

Figure 3:
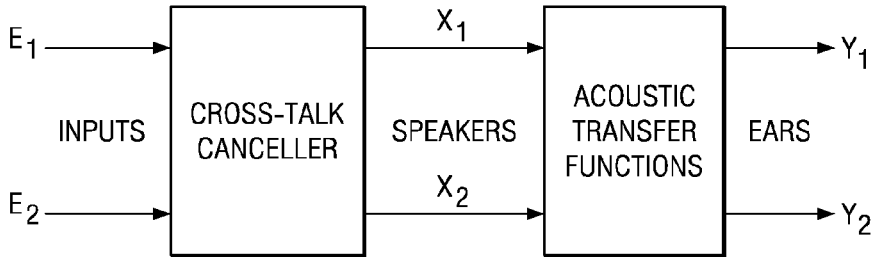
FIG. 3 (PRIOR ART)
FIG. 3 is a cross-talk cancellation system.

Now FIG. 3 shows a cross-talk cancellation system in which the input electrical signals (Fourier transformed) $E_1(e^{j\omega})$, $E_2(e^{j\omega})$ are modified to give the signals $X_1$, $X_2$ to drive the loudspeakers. This transform from $E_1$, $E_2$ to $X_1$, $X_2$ is also a linear transformation and represented by a 2×2 matrix. If the target is to reproduce signals $E_1$, $E_2$ at the listener's ears (so $Y_1=E_1$ and $Y_2=E_2$) and thereby cancel the effect of the cross-talk (due to $H_2$ not 0), then the 2×2 matrix should be the inverse of the 2×2 matrix with elements $H_1$ and $H_2$. Thus, $$\begin{bmatrix} X_1 \\ X_2 \end{bmatrix} = \frac{1}{H_1^2 - H_2^2} \begin{bmatrix} H_1 & -H_2 \\ -H_2 & H_1 \end{bmatrix} \begin{bmatrix} E_1 \\ E_2 \end{bmatrix}$$

An efficient implementation of the cross-talk canceller appears in the D. Cooper et al. article cited in the background; namely, diagonalize the 2×2 matrix with elements $H_1$ and $H_2$:

$$\begin{bmatrix} H_1 & H_2 \\ H_2 & H_1 \end{bmatrix} = \frac{1}{2} \begin{bmatrix} 1 & 1 \\ 1 & -1 \end{bmatrix} \begin{bmatrix} M_0 & 0 \\ 0 & S_0 \end{bmatrix} \begin{bmatrix} 1 & 1 \\ 1 & -1 \end{bmatrix}$$

where $M_0(e^{j\omega})=H_1(e^{j\omega})+H_2(e^{j\omega})$ and $S_0(e^{j\omega})=H_1(e^{j\omega})-H_2(e^{j\omega})$. Thus the inverse becomes simple:

$$\begin{bmatrix} H_1 & H_2 \\ H_2 & H_1 \end{bmatrix}^{-1} = \frac{1}{2} \begin{bmatrix} 1 & 1 \\ 1 & -1 \end{bmatrix} \begin{bmatrix} 1/M_0 & 0 \\ 0 & 1/S_0 \end{bmatrix} \begin{bmatrix} 1 & 1 \\ 1 & -1 \end{bmatrix}$$

Figure 4:
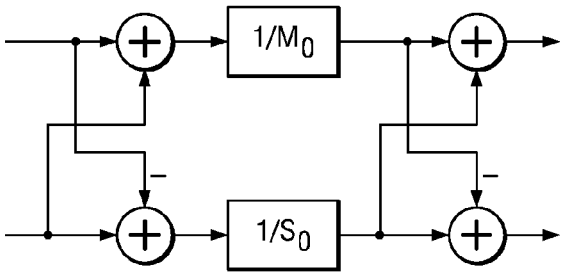
FIG. 4 (PRIOR ART)
FIG. 4 is a shuffler cross-talk cancellation arrangement.

And the cross-talk cancellation is efficiently implemented as sum/difference detectors with the inverse filters $1/M_0(e^{j\omega})$ and $1/S_0(e^{j\omega})$, as shown in FIG. 4. This structure is referred to as the "shuffler" cross-talk canceller.

Figure 5:
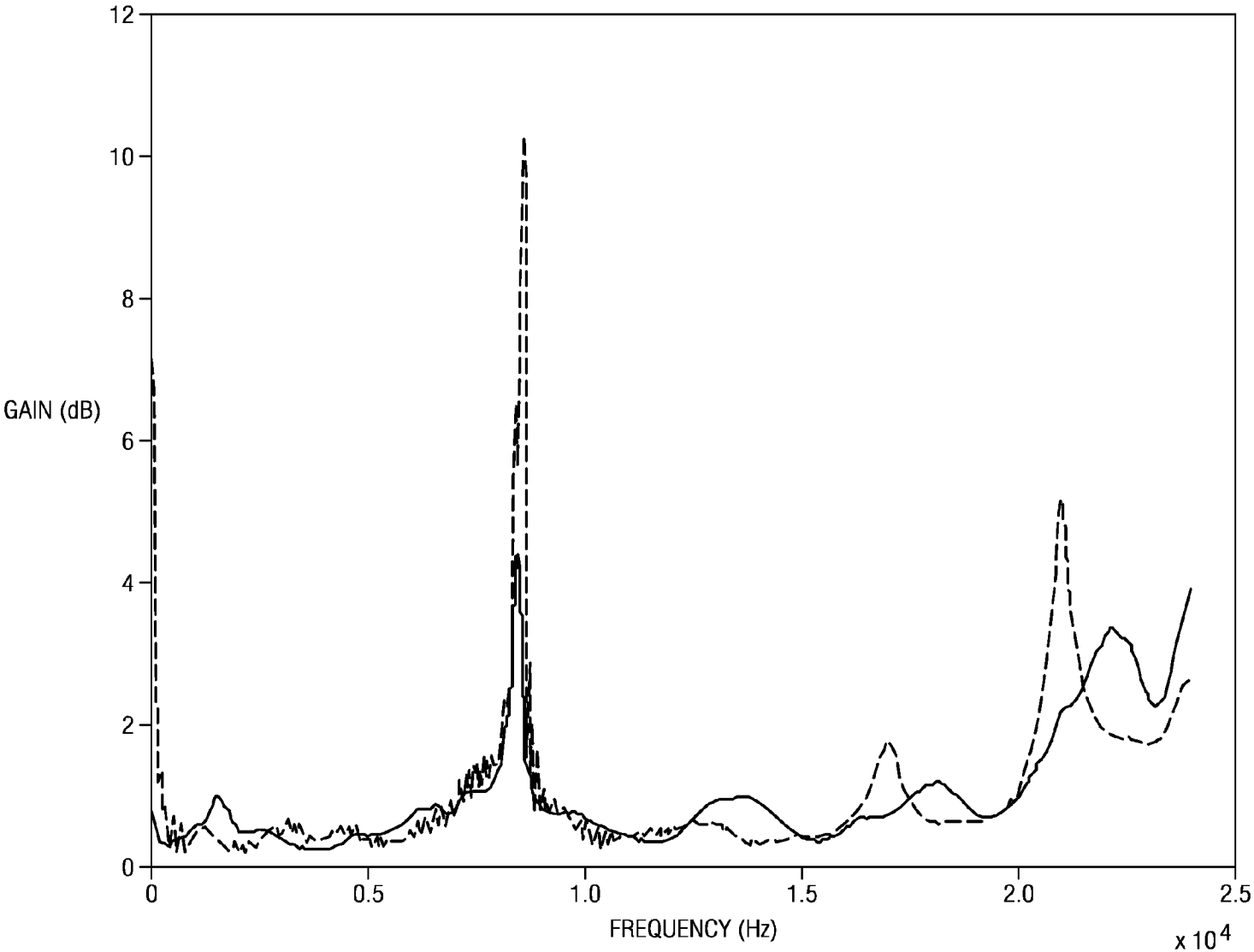
FIG. 5 illustrates spectral peaks.

However, a practical problem arises in the actual implementation. FIG. 5 shows the magnitude spectra of $1/M_0(e^{j\omega})$ and $1/S_0(e^{j\omega})$, for a typical loudspeaker arrangement where the center of the listener's head and the centers of the speakers form an equilateral triangle. This corresponds to the case where $H_1(e^{j\omega})$ and $H_2(e^{j\omega})$ are HRTF transfer functions for 30/330 degrees. The figure shows the significant peaks for frequencies near 8 KHz and also at higher frequencies; these peaks correspond to approximate nulls in the transfer functions $M_0(e^{j\omega})=H_1(e^{j\omega})+H_2(e^{j\omega})$ and $S_0(e^{j\omega})=H_1(e^{j\omega})-H_2(e^{j\omega})$. The implementation of such filters would require considerable dynamic range reduction in order to avoid saturation about frequencies with response peaks.

3. Frequency Band Cross-Talk Cancellation

It is widely known that cross-talk cancellation does not behave properly at higher frequencies due to the shorter wavelength and consequent sensitivity to listener head movement. For example, at 8 KHz the acoustic wavelength is on the order of 4 cm, which means that even slight deviations from the cross-talk cancellation sweet spot would have significant impact. On the other hand, at higher frequencies the head itself acts as a natural barrier for the cross-talk sound wave due to relatively small diffraction at short wavelengths. Thus the first preferred embodiment cross-talk cancellation performs cross-talk cancellation only on the lower frequencies and lets the natural acoustic barrier of the head act on the higher frequencies.

FIG. 1*a* illustrates a first preferred embodiment cross-talk cancellation system which uses lowpass filter $F_0(e^{j\omega})$ and highpass filter $F_1(e^{j\omega})$ to separate both the left and right input signals, $L_{in}(e^{j\omega})$ and $R_{in}(e^{j\omega})$, into low and high frequency bands: $L_{low}(e^{j\omega})$ and $R_{low}(e^{j\omega})$ are the left and right low signal frequencies and $L_{high}(e^{j\omega})$ and $R_{high}(e^{j\omega})$ are the left and right high signal frequencies. The low frequencies are fed into a shuffler cross-talk canceller (see FIG. 4) with left and right outputs denoted $L_{xtc}(e^{j\omega})$ and $R_{xtc}(e^{j\omega})$. The left and right cross-talk-cancelled low frequencies are then mixed back in with the left and right high frequencies, respectively; the high frequencies are weighted by k in order to compensate for any attenuation introduced by the shuffler cross-talk cancellation filter. That is, the left and right overall outputs, $L_{out}(e^{j\omega})$ and $R_{out}(e^{j\omega})$, are: $L_{out}(e^{j\omega})=L_{xtc}(e^{j\omega})+k\,L_{high}(e^{j\omega})$ and $R_{out}(e^{j\omega})=R_{xtc}(e^{j\omega})+k\,R_{high}(e^{j\omega})$.

The lowpass filter, $F_0(e^{j\omega})$, has a cut-off frequency of 8 KHz in order to attenuate the large peaks apparent in FIG. 5. Thus the preferred embodiment method of cross-talk cancellation avoids the problem of dynamic range compression for matrix inversion.

The lowpass and highpass filters, $F_0(e^{j\omega})$ and $F_1(e^{j\omega})$, could be very efficiently realized as power-complementary IIR filters; that is, with $|F_0(e^{j\omega})|^2+|F_1(e^{j\omega})|^2$=constant. The power-complementarity provides efficient separation of the signals into low and high frequency bands without introduction of significant distortions when the bands are recombined by addition. In particular, take the lowpass filter to have the form $F_0(z)=(A_0(z)+A_1(z))/2$ where $A_0(z)$ and $A_1(z)$ are both allpass filters ($|A_0(e^{j\omega})|=|A_1(e^{j\omega})|=1$) that contain interlaced poles of $F_0(z)$. Pole-interlacing separation allows a simple highpass filter definition: $F_1(z)=F_0(-z)=(A_0(z)-A_1(z))/2$. The decomposition into $A_0(z)$ and $A_1(z)$ is generally possible for Butterworth, Chebyshev, and elliptic filters. A simple example of the two allpass filters resulting from the decomposition of a 3rd order low-pass filter could be $A_0(z)=(d_1+z^{-1})/(1+d_1z^{-1})$ and $A_1(z)=(d_2+d_3z^{-1}+z^{-2})/(1+d_3z^{-1}+d_2z^{-2})$ with $d_1$, $d_2$, and $d_3$ real numbers. $d_1$, $d_2$, and $d_3$ are obtained by separating the real pole from the two complex conjugate poles of $F_0(z)$.

FIG. 1*b* illustrates the overall method of first find the spectra of the HRTFs, $H_1(e^{j\omega})$ and $H_2(e^{j\omega})$, for a given (symmetric) loudspeaker-listener geometry; next, estimate the spectra of $M_0(e^{j\omega})=H_1(e^{j\omega})+H_2(e^{j\omega})$ and $S_0(e^{j\omega})=H_1(e^{j\omega})-H_2(e^{j\omega})$, then design a lowpass filter $F_0(z)$ with a cutoff frequency defined as the maximum frequency $\omega_0$ where $1/|M_0(e^{j\omega})|$, $1/|S_0(e^{j\omega})|\leqq T$ for all $\omega_{min}\leqq\omega\leqq\omega_0$ with $\omega_{min}$ a minimum frequency (such as 20 Hz) to avoid the approximate null in $S_0(e^{j\omega})$ at $\omega=0$. The value of T is determined by the desired dynamic range and tolerable saturation. For example, for the geometry leading to FIG. 5 the value of T could be in the range of 2-3 dB.

4. Experimental Results

The first preferred embodiment cross-talk cancellation was tested using a full-scale sweep signal that covered the whole digital spectrum and also using music and speech signals. The test consisted of tuning up both the conventional and the preferred embodiment methods to give a full-scale output for the sweep signal, and then measuring the outputs for other types of signals. The observed attenuation is a measure of the reduction in dynamic range suffered by real-world signals. The results are summarized in the following table:

| signal | attenuation (conventional) | attenuation (preferred embodiment) |
|---|---|---|
| sweep | 0 dB | 0 dB |
| male speech | −12.9 dB | −9.5 dB |
| live music | −11.4 dB | −8.2 dB |
| cello solo | −13.7 dB | −9.8 dB |

The table indicates that the preferred embodiment method showed an improvement of up to 3.9 dB. Also, informal listening comparisons using a piano note that goes around the head on the horizontal plane failed to detect any degradation in cross-talk cancellation performance, and in addition to the dynamic range improvement, the method showed better subjective quality in terms of spectral coloration which is minimized at higher frequencies.

5. Multiple Bands and Loudspeakers

Further preferred embodiments apply the same separation of low and high frequencies to avoid spectral peaks from matrix inversion to other situations. For example, two loudspeakers asymmetrically oriented with respect to the listener implies four distinct acoustic paths from loudspeaker to ear instead of two and thus an asymmetrical 2×2 matrix to invert. Similarly, three or more loudspeakers implies six or more acoustic paths and non-square matrices with matrix pseudo-inverses to be used for cross-talk cancellations.

What is claimed is:

1. A method of audio processing, comprising:

(a) separating left and right input signals into low frequency bands and high frequency bands;

(b) applying cross-talk cancellation to said low frequency bands to have left and right cross-talk cancelled outputs; and (c) combining said left high frequency band with said left cross-talk cancelled output, and combining said right high frequency band with said right cross-talk cancelled output;

(d) wherein a cutoff frequency for said low frequency bands is determined by a peak in the frequency dependence of an inverse matrix of head-related transfer functions.

2. The method of claim 1, wherein:

(a) said inverse matrix is 2×2 symmetric; and (b) said cutoff frequency is the maximum frequency $\omega_0$ where $1/|M_0(e^{j\omega})|$, $1/|S_0(e^{j\omega})| \leqq T$ for all $\omega_{min} \leqq \omega \leqq \omega_0$ with T a threshold, $\omega_{min}$ a minimum frequency, and $M_0(e^{j\omega})=H_1(e^{j\omega})+H_2(e^{j\omega})$ and $S_0(e^{j\omega})=H_1(e^{j\omega})-H_2(e^{j\omega})$, where $H_1(e^{j\omega})$ and $H_2(e^{j\omega})$ are said head-related transfer functions.

3. The method of claim 2, wherein:

(a) said threshold is in the range of 2-3 dB.

4. An audio cross-talk canceller, comprising:

(a) first and second lowpass filters with inputs for first and second signals;

(b) first and second highpass filters with inputs for said first and second signals;

(c) a shuffle cross-talk canceller with inputs coupled to outputs of said first and second lowpass filters;

(d) first and second outputs coupled to said shuffle cross-talk canceller and to outputs of said first and second highpass filters;

(e) wherein said first and second lowpass filters have cutoff frequencies determined from a peak in the frequency dependence of an inverse matrix of head-related transfer functions.

5. The canceller of claim 4, further comprising:

(a) first and second gain elements coupled between said first and second outputs of said outputs or said first and second highpass filters.

* * * * *